US012228367B2

(12) United States Patent
Liu

(10) Patent No.: US 12,228,367 B2
(45) Date of Patent: Feb. 18, 2025

(54) PLUGGABLE GUN HOLSTER ASSEMBLY

(71) Applicant: KRISS INDUSTRIES ASIA LTD., New Taipei (TW)

(72) Inventor: Cheng-Yuan Liu, New Taipei (TW)

(73) Assignee: KRISS INDUSTRIES ASIA LTD., New Taipei (TW)

( * ) Notice: Subject to any disclaimer, the term of this patent is extended or adjusted under 35 U.S.C. 154(b) by 154 days.

(21) Appl. No.: 18/080,218

(22) Filed: Dec. 13, 2022

(65) Prior Publication Data

US 2024/0085146 A1 Mar. 14, 2024

(30) Foreign Application Priority Data

Sep. 14, 2022 (TW) ..... 111134792

(51) Int. Cl.
*F41C 33/02* (2006.01)

(52) U.S. Cl.
CPC ..... *F41C 33/0236* (2013.01)

(58) Field of Classification Search
CPC ..... F41C 33/0236; F41C 33/0245
See application file for complete search history.

(56) References Cited

U.S. PATENT DOCUMENTS 5,544,794 A * 8/1996 Nichols ..... F41C 33/0245 224/678
5,570,830 A * 11/1996 Nichols ..... F41C 33/0236 224/679
8,720,755 B2 * 5/2014 Gregory ..... F41C 33/0263 224/244
9,777,986 B1 * 10/2017 Lance ..... F41C 33/0254
2007/0181619 A1 * 8/2007 Seyfert ..... F41C 33/04 224/912
2012/0187163 A1 * 7/2012 Tyybakinoja ..... A45F 5/021 224/663
2013/0240582 A1 * 9/2013 Tyybakinoja ..... F41C 33/0236 224/244
2020/0232755 A1 * 7/2020 Houck ..... F41C 33/0227

* cited by examiner

*Primary Examiner* — Derek J Battisti
(74) *Attorney, Agent, or Firm* — Locke Lord LLP; Tim Tingkang Xia, Esq.

(57) ABSTRACT

Disclosed is a pluggable gun holster assembly, including a gun body, a holster body and a limiting device. The gun body includes a gun head and a trigger part, and the gun head has a muzzle. An accommodating groove is formed between the trigger part and the gun head. The holster body includes an accommodating space and a hole. The accommodating space is configured through both ends of the holster body, and the hole is located on one side of the accommodating space. The limiting device is disposed in the hole, and the limiting device includes a buffer block extending from the hole to the accommodating space.

7 Claims, 9 Drawing Sheets

PLUGGABLE GUN HOLSTER ASSEMBLY

CROSS-REFERENCE TO RELATED APPLICATIONS

This application claim priority to TAIWAN application Numbered 111134792, filed Sep. 14, 2022, which is herein incorporated by reference in its' integrity.

BACKGROUND OF THE INVENTION

Field of the Invention

The present disclosure relates to a holster assembly, and more particularly, to a pluggable holster assembly which allows a user to draw a firearm (or pistol) from a holster and reholsters the pistol more easily and quickly.

Description of the Related Art

A conventional gun holster has no safety devices to prevent accidental gun discharges when a gun is placed inside the gun holster, and this brings the user to be exposed to dangerous conditions or situations.

In addition, according to laws or related regulations, law enforcement officers and police officers with guns must place pistols in the gun holster correctly and safely to prevent the pistols from being robbed during their missions.

As a result, most of the conventional gun holsters are designed based on the aforementioned basic safety principles. However, such conventional gun holsters would affect the speed of drawing and reholstering a pistol.

Therefore, providing a gun holster capable of facilitating the drawing and reholstering of the pistol, e.g., safety and seed, is desired for the industries.

SUMMARY OF THE INVENTION

One of the objectives of the present invention is to provide a pluggable holster assembly capable of preventing the trigger from being accidentally touched or incorrectly operated, thereby improving safety.

Another object of the present invention is providing a pluggable holster assembly that can be operated by only one hand. Specifically, the pluggable holster assembly has a limiting device that makes the operation of the firearm more easily.

In view of this, an embodiment of the current invention provides a pluggable gun holster assembly comprising: a gun body including a gun head, a gun body, a trigger part and a gun handle, the gun head having a muzzle, one end of the gun body being connected to the gun head, the gun handle being connected to the gun body and away from one side of the gun head, the trigger part being connected to the gun body and the gun handle, and an accommodating groove being created between the trigger part and the gun head; a holster body including an accommodating space and a hole, the accommodating space being configured through both ends of the holster body along a first direction, the accommodating space accommodating the gun head and the trigger part, and the hole being located on one side of the accommodating space; a limiting device disposed in the hole, the limiting device including a buffer block, the buffer block extending from the hole to the accommodating space along a second direction, wherein, when the buffer block is in a first position, the buffer block extends from a surface of the accommodating space at a first distance; wherein, when the gun body is inserted into the holster body, the muzzle is inserted into the holster body from a first side of the accommodating space along a path, and one end of the gun head abuts the buffer block, so that the buffer block is located on a second position; and when the muzzle moves to a second side of the accommodating space, the holster body covers the gun head and the trigger part, and the buffer block is located in the accommodating groove and restricts the gun body from moving.

Another embodiment of the current invention provides the gun holster assembly, wherein the first direction is a direction along which the holster body extends, and the first direction is perpendicular to the second direction.

Another embodiment of the current invention provides the gun holster assembly, wherein, when the buffer block is located at the second position, the buffer block extends from the surface of the accommodating space at a second distance, and the second distance is less than the first distance.

Another embodiment of the current invention provides the gun holster assembly, wherein the limiting device further comprises a box body, an adjuster and a spring, the box body having a groove to which a third end of the adjuster is connected while one end of the spring is connected to a fourth end of the adjuster, and the other end of the spring is connected to the buffer block, so that the buffer block can be located at the first position or the second position via the spring.

Another embodiment of the current invention provides the gun holster assembly, wherein the limiting device further includes an adjusting screw, the adjusting screw being arranged in a through hole of the groove, and one end of the adjusting screw abutting the fourth end of the adjuster.

Another embodiment of the current invention provides the gun holster assembly, wherein, when the adjusting screw performs a rotational displacement movement through the through hole, the adjusting screw performs a linear displacement movement along the second direction, so that the adjuster performs the linear displacement movement.

Another embodiment of the current invention provides the gun holster assembly, wherein the limiting device further comprises at least one fixing plug, the at least one fixing plug is arranged on one side of the box body and penetrates the holster body, so that the limiting device is fixed in the hole.

Another embodiment of the current invention provides the gun holster assembly, wherein one side of the holster body corresponding to the hole is recessed along the first direction to form a gap.

Another embodiment of the current invention provides the gun holster assembly, wherein the path is a polyline path passing through the gap, and one or more turning points of the path are located on the buffer block.

Another embodiment of the current invention provides the gun holster assembly, wherein the end of the gun head abuts a surface of the buffer block, and the surface of the buffer block is an arc surface, a plane or a surface composed of a plurality of planes connected in series.

In embodiments of the current invention, the pluggable holster assembly features in the design of the gun holster. For example, the gun head and the trigger part are accommodated in the accommodating space to prevent the trigger from accidental operation that causes safety problems, thereby improving security.

Furthermore, through the design and combining of the accommodating groove and the buffer block, one-handed operation can be performed, and the drawing and reholstering of the gun body for the holster body becomes more efficiently. Specifically, the accommodating groove and the buffer block can be quickly limited and released quickly during operation that improves the drawing and reholstering speed of pistols (or firearms).

Additionally, through the design of the gap and the buffer block, the user can reholster the gun body into the holster body through the path in smoothly.

DESCRIPTION OF THE PREFERRED EMBODIMENTS

Figure 1:
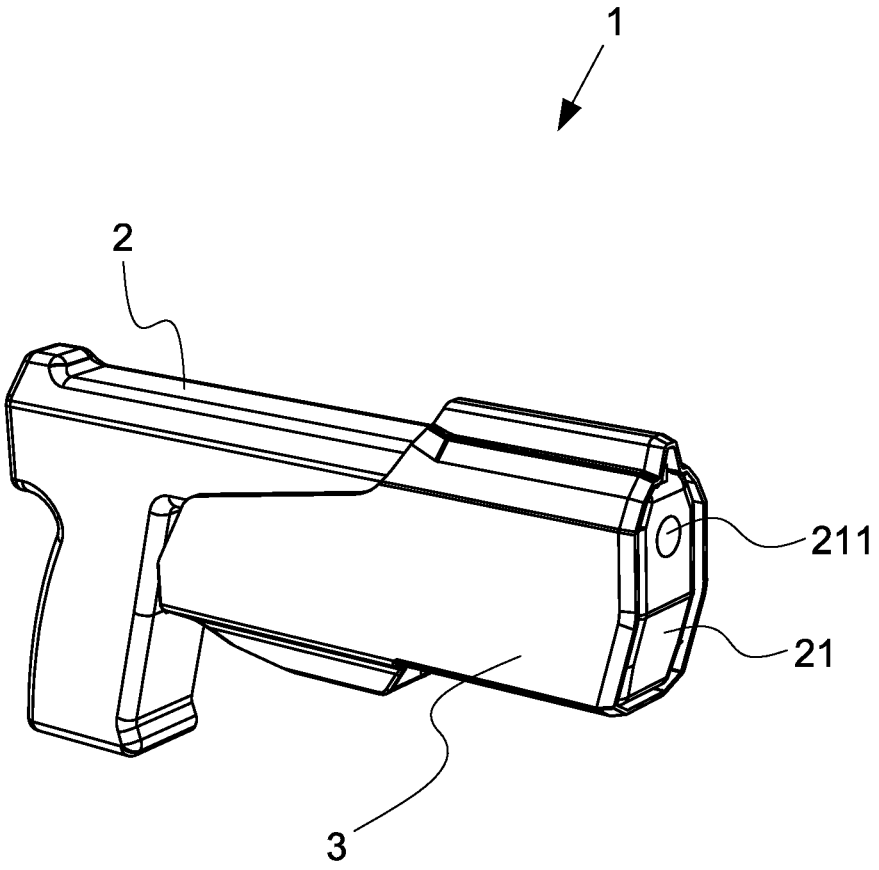
FIG. 1 shows an overall schematic view of a pluggable holster assembly according to an embodiment of the present invention.
Figure 2:
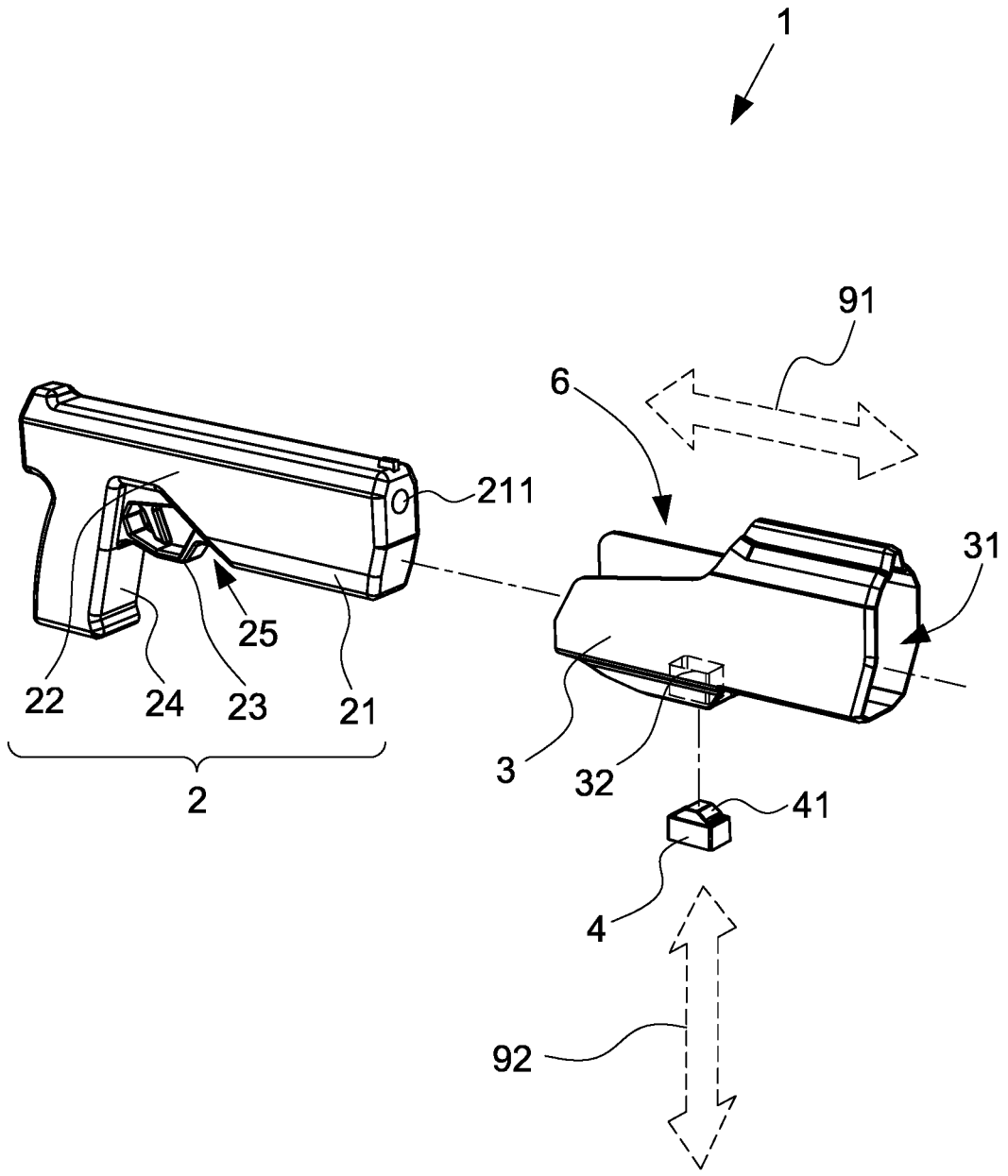
FIG. 2 shows an explosion view of a pluggable holster assembly according to an embodiment of the present invention.
Figure 3:
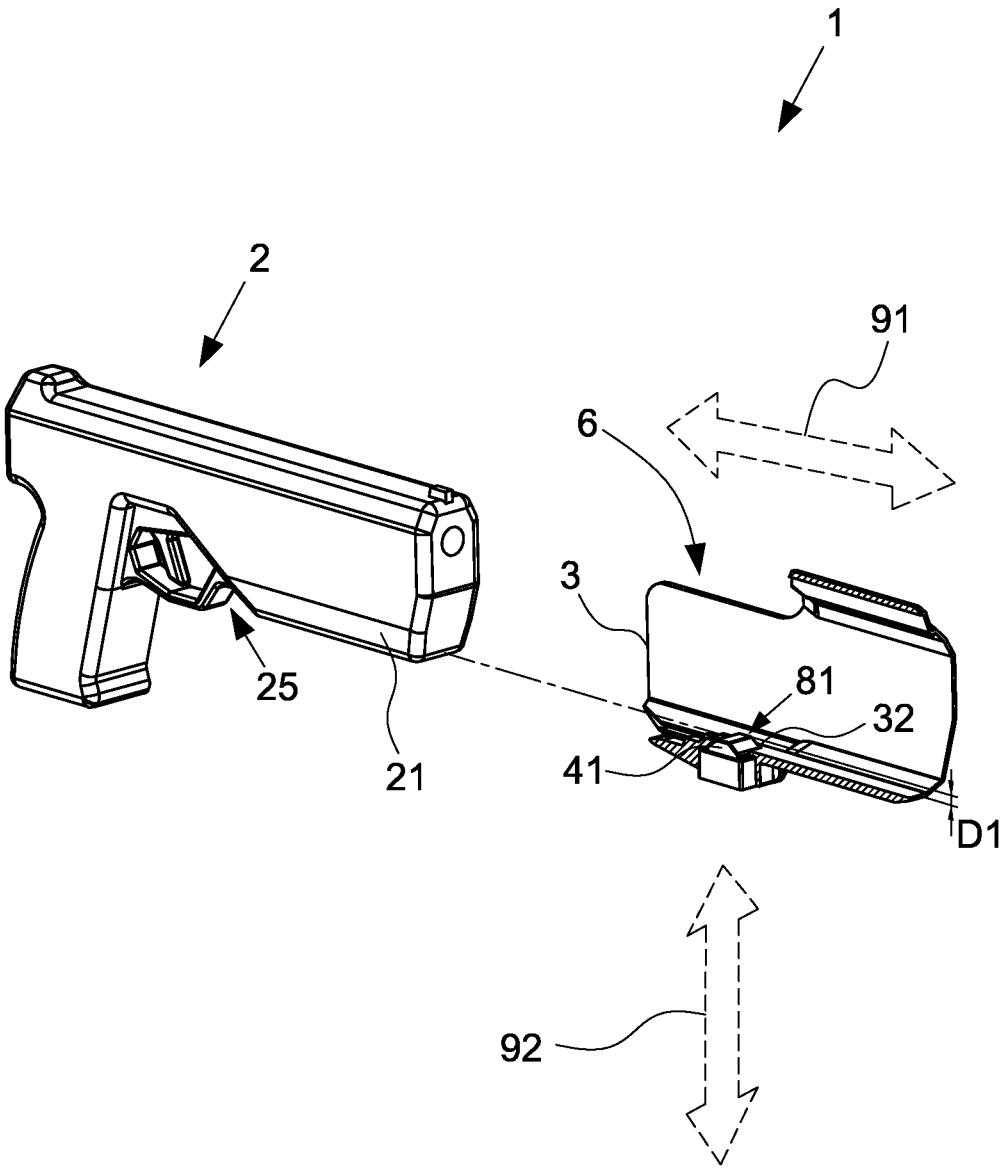
FIG. 3 shows a partial section view of a pluggable holster assembly according to an embodiment of the present invention.

Please refer to FIG. 1 to FIG. 3, the present invention provides a pluggable holster assembly 1 that includes a gun body 2, a holster body 3 and a limiting device 4.

The gun body 2 includes a gun head 21, a main part 22, a trigger part 23 and a gun handle 24. The gun head 21 has a muzzle 211 and connects to one end of the main part 22. The gun handle 24 is connected to the main part 22 and away from one side of the gun head 21. The trigger part 23 is connected to the main part 22 and the gun handle 24. Furthermore, an accommodating groove 25 is created between the trigger part 23 and the gun head 21.

The holster body 3 includes an accommodating space 31 and a hole 32. The accommodating space 31 penetrates both ends of the holster body 3 along a first direction 91. The accommodating space 31 accommodates the gun head 21 and the trigger part 23. The hole 32 is located on one side of the accommodating space 31. In this embodiment, the first direction 91 is a direction along which a line between two ends of the holster body 3 extends, but not limited to this.

The limiting device 4 is disposed in the hole 32, and the limiting device 4 includes a buffer block 41. The buffer block 41 extends from the hole 32 to the accommodating space 31 along a second direction 92. When the buffer block 41 is located at a first position 81, the buffer block 41 extends from a surface of the accommodating space 31 at a first distance D1.

When the gun body 2 is inserted into the holster body 3, the muzzle 211 is inserted into the holster body 3 from one side of the accommodating space 31 along a path 5, and one end of the gun head 21 abuts the buffer block 41, so that the buffer block 41 is located at a second position 82. Additionally, the end of the gun head 21 abuts a surface of the buffer block 41, and the surface is an arc surface, a plane or a surface composed of a plurality of planes connected in series.

When the muzzle 211 moves to another side of the accommodating space 31, the holster body 3 covers the gun head 21 and the trigger part 23, and the buffer block 41 is located in the accommodating groove 25 and restricts the gun body 2 from moving.

In addition, when the gun body 2 is drawn from the holster body 3, the muzzle 211 moves from another side of the accommodating space 31 to a different side of the accommodating space 31. An open end of the accommodating groove 25 abuts the buffer block 41, and the buffer block 41 is moved out of the accommodating groove 25 so that the gun body 2 is taken out.

Furthermore, the first direction 91 is the direction along which the gun holster 2 extends, that is, the insertion direction along which the gun body 2 is inserted into the holster body 3. The buffer block 41 extends from the hole 32 to the accommodating space 31 along the second direction 92, that is, the direction along which when the buffer block 41 extends into the accommodating slot 25. In this embodiment, the first direction 91 and the second direction 92 are perpendicular to each other, but not limited thereto.

Figure 4:
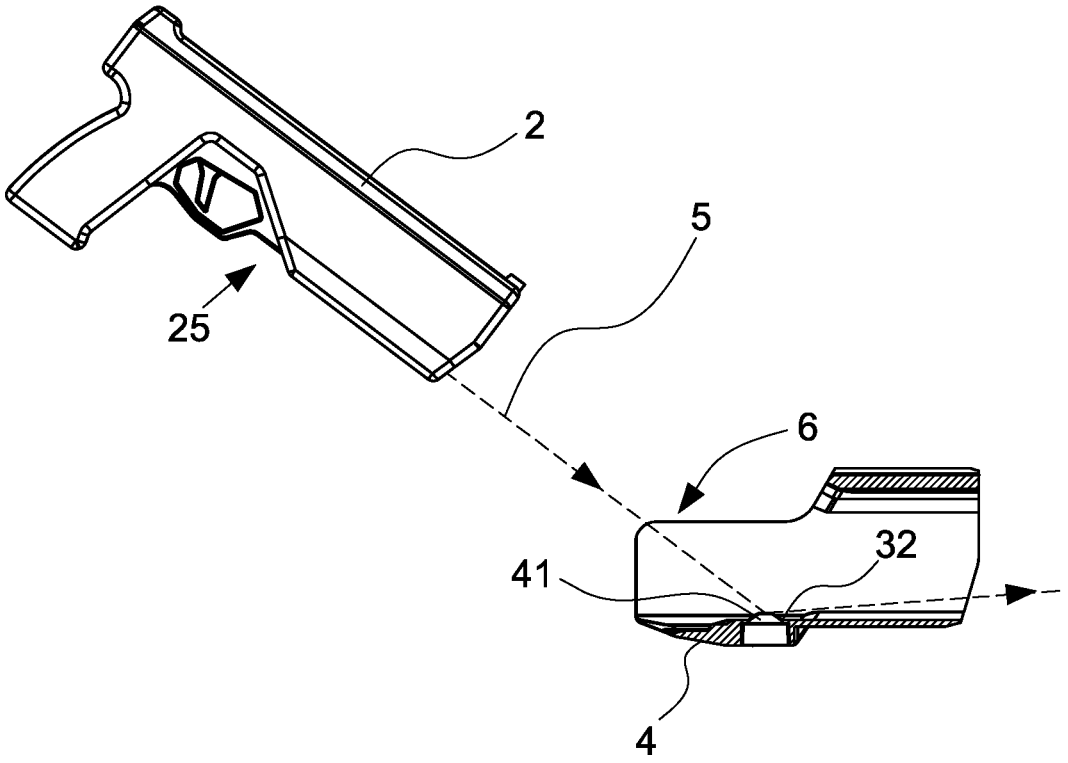
FIG. 4 shows insertion of a gun body into a holster body according to an embodiment of the present invention.

Please additionally refer to FIG. 4, in one embodiment, one side of the holster body 3 corresponding to the hole 32 is recessed along the first direction 91 to form a gap 6. Therefore, the path 5 can be a polyline path that passes through the gap 6, and turning points of the path 5 are located on the buffer block 41.

Figure 5:
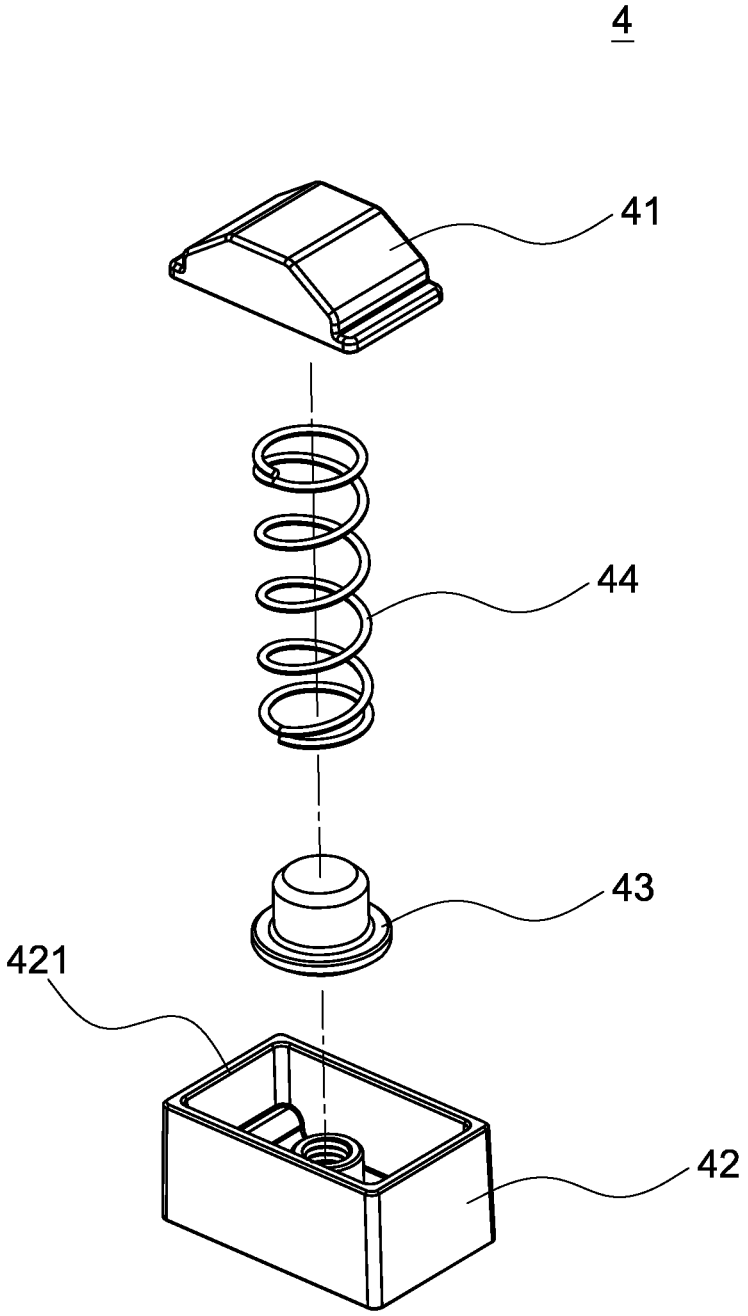
FIG. 5 shows an explosion view of a limiting device according to an embodiment of the present invention.
Figure 6A:
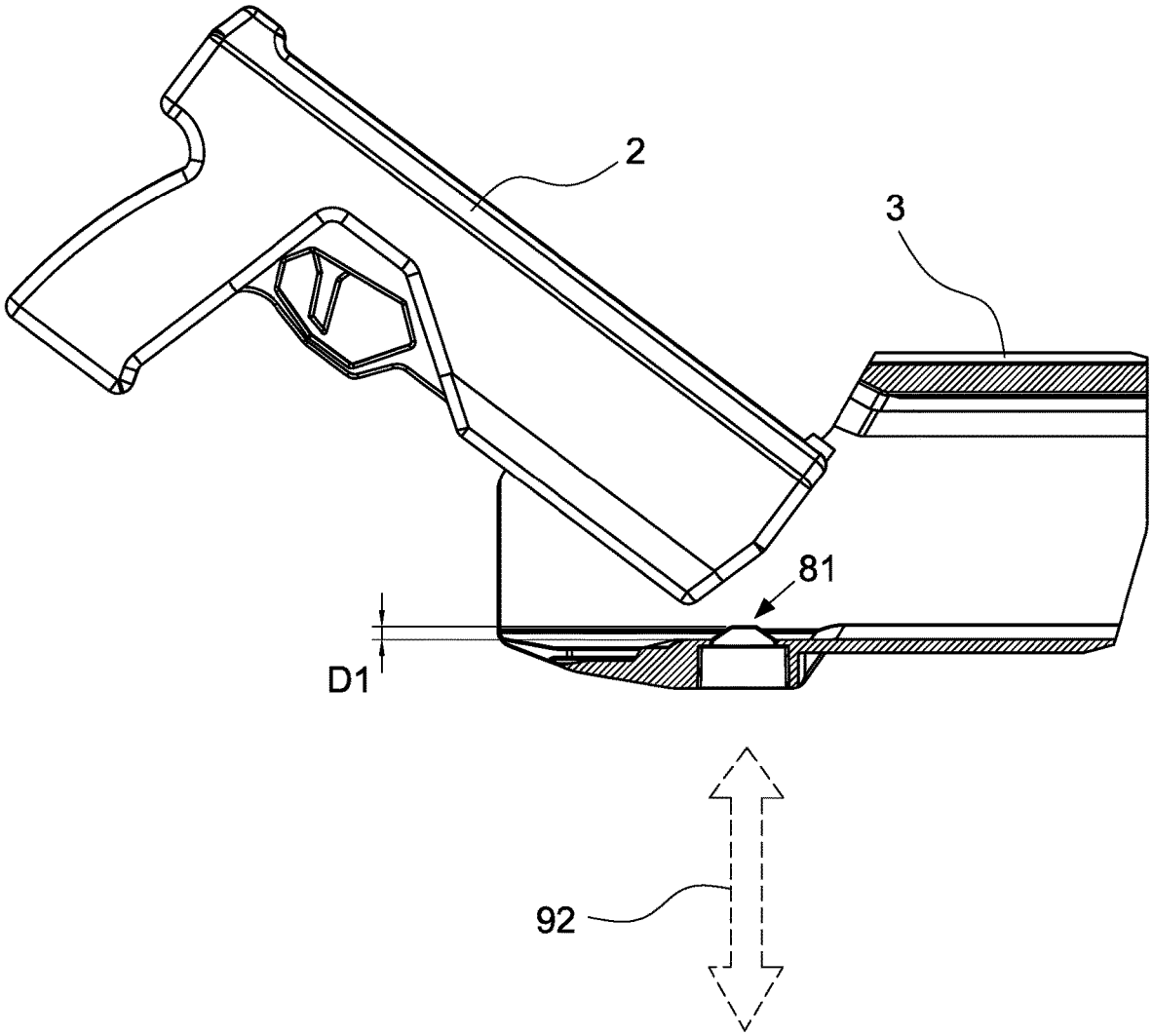
FIG. 6A shows an operation state where a buffer block remains at a first position according to an embodiment of the present invention.
Figure 6B:
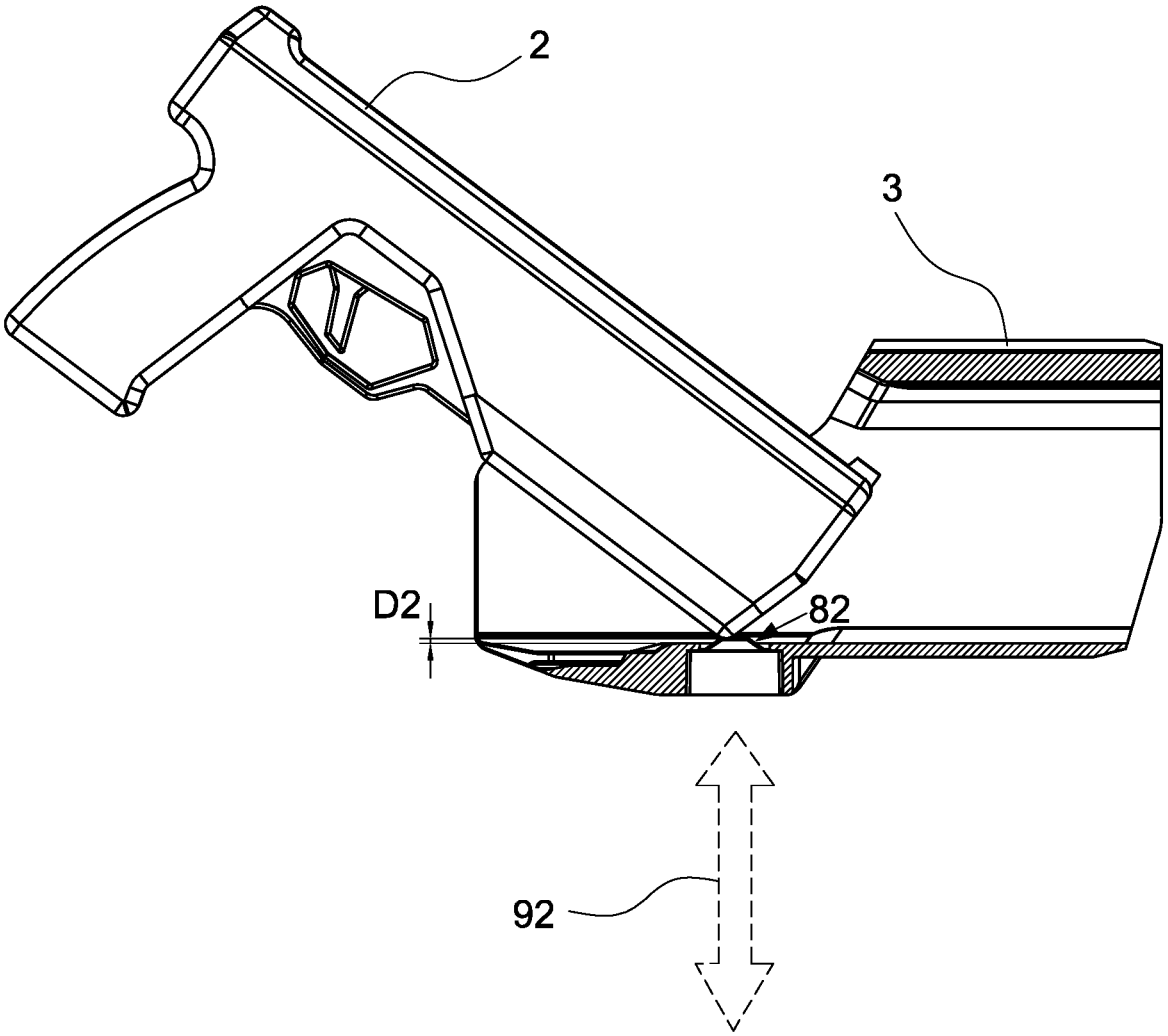
FIG. 6B shows an operation state where a buffer block remains at a first position according to an embodiment of the present invention.

In embodiments of FIG. 5, FIG. 6A and FIG. 6B, the limiting device 4 further includes a box body 42, an adjuster 43 and a spring 44. The box body 42 has a groove 421. One end of the adjuster 43 is connected to the groove 421, and one end of the spring 44 is connected to another end of the adjuster 43. Another end of the spring 44 is connected to the buffer block 41, so that the buffer block 41 can be located at the first position 81 or the second position 82 via the spring 44.

When the gun body 2 is inserted into the holster body 3, one end of the gun head 21 abuts the buffer block 41, so that the spring 44 is squeezed, and the buffer block 41 compresses the spring 44 from the first position 81 along the second direction 92, thus, the buffer block 41 is located at the second position 82. When the buffer block 41 is located at the second position 82, the buffer block 41 extends from a surface of the accommodating space 31 at a second distance D2 that is less than the first distance D1.

Figure 7:
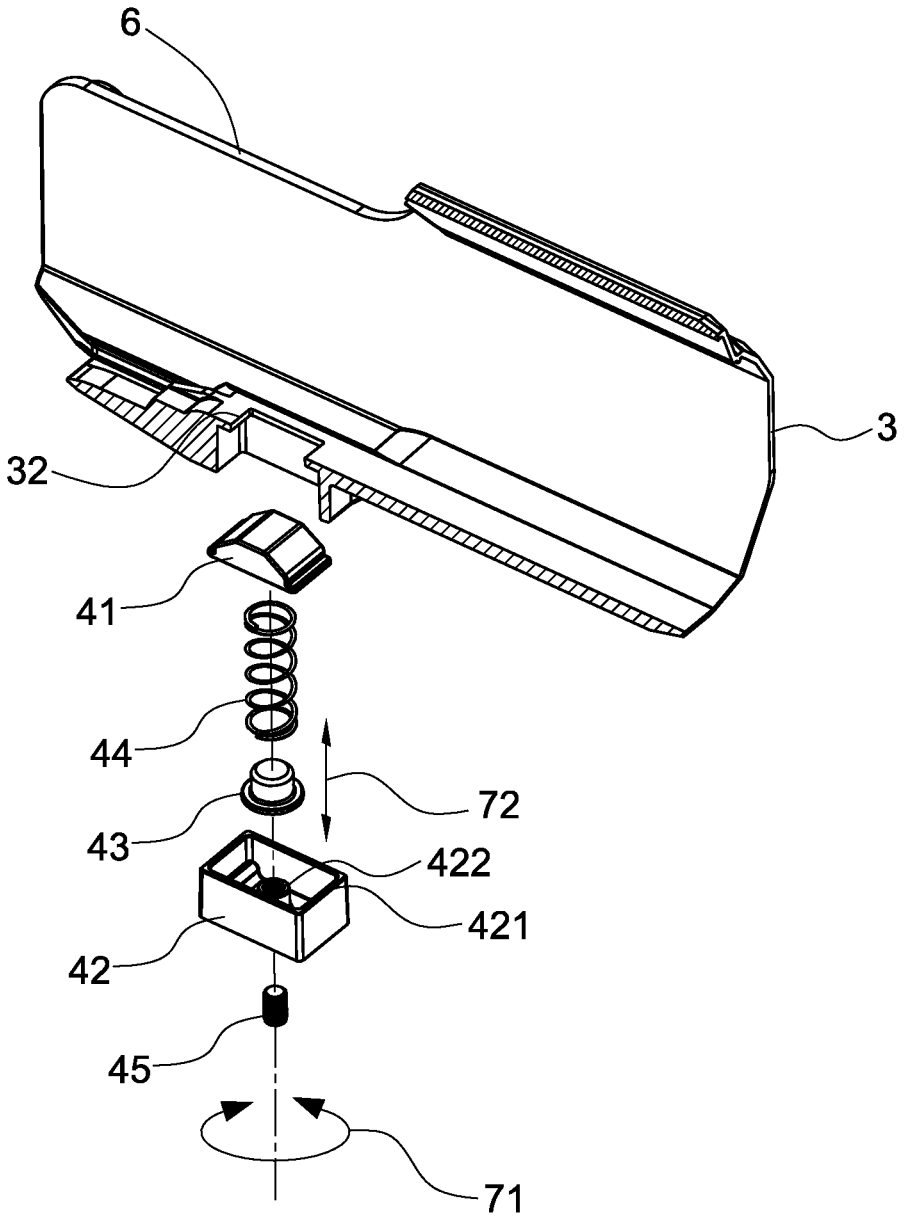
FIG. 7 shows an explosion view of a limiting device according to another embodiment of the present invention.

In embodiments of FIG. 7, the limiting device 4 further includes an adjusting screw 45 that is arranged in a through hole 422 of the groove 421. One end of the adjusting screw 45 abuts another end of the adjuster 43.

When the adjusting screw 45 performs a rotational displacement movement 71 along the center line of the through hole 422 as the central axis, the adjusting screw 45 accordingly performs a linear displacement movement 72 along the second direction 92, and one end of the adjusting screw 45 abuts another end of the adjuster 43, so that the adjuster 43 performs the linear displacement movement 72.

Additionally, when the adjusting screw 45 performs the rotational displacement movement 71 (e.g., clockwise rotation), the adjuster 43 performs the linear displacement movement 72 along a direction close to the accommodating space 31, and the adjuster 43 will compress the spring 44, so that the space between the buffer block 41 and the adjuster 43 decreases. Therefore, the compressible space of the spring 44 becomes smaller, this means that the gun head 21 needs to exert a larger impact force against buffer block 41 so as to move the buffer block 41 from the first position 81 to the second position 82.

On the other hand, when the adjusting screw 45 performs the rotational displacement movement 71 (e.g., counter-clockwise rotation), the adjuster 43 performs the linear displacement movement 72 in the direction away from the accommodating space 31, and the adjuster 43 will gradually release the spring 44, so that the space between the buffer block 41 and the adjuster 43 increases. Therefore, the compressible space of the spring 44 becomes larger, this means that the gun head 21 exerts a smaller impact force against the buffer block 41 so as to move the buffer block 41 from the first position 81 to the second position 82.

That is, adjustment of the adjuster 43 and the spring 44 by the adjusting screw 45 to move the buffer block 41 from the first position 81 to the second position 82 determines the desired impact forces.

In addition, the rotation direction of the adjustment screw 45, the compression or reduction of the spring 44 by the adjuster 43, and the relationship between the related elements can be properly modified in other various embodiments.

Figure 8:
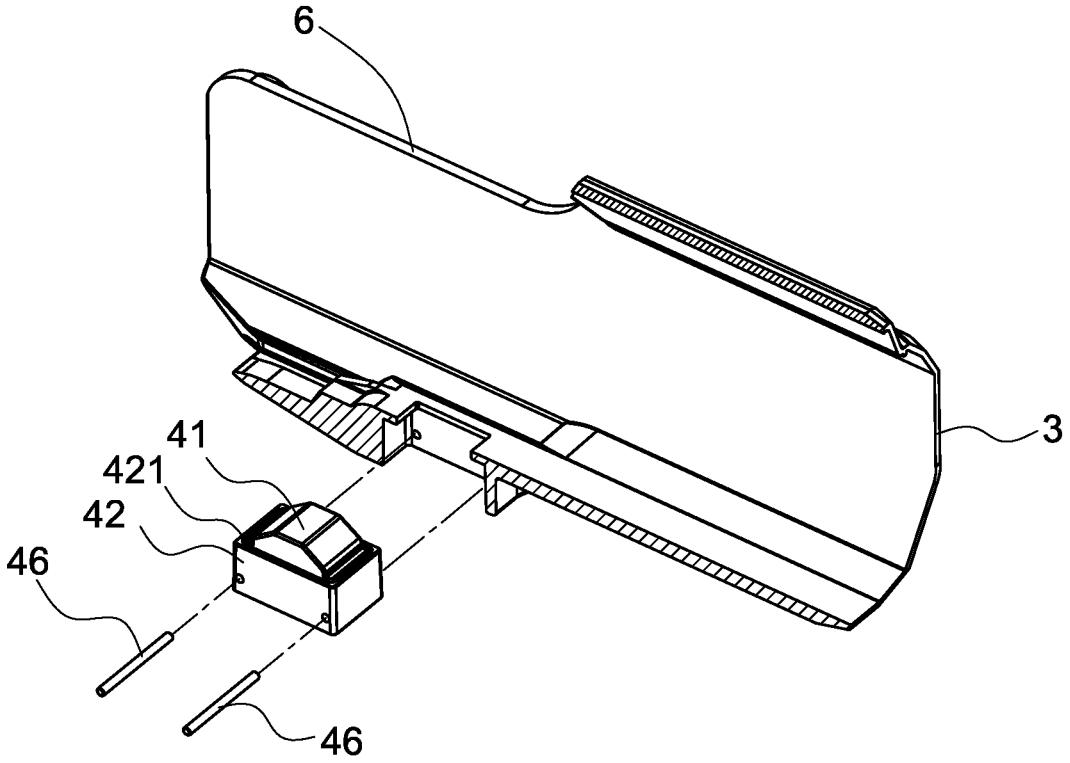
FIG. 8 shows an explosion view of a limiting device according to another embodiment of the present invention.

In embodiments of FIG. 8, the limiting device 4 further includes at least one fixed pin 46, and the fixed pin 46 is disposed on one side of the box body 42. The fixing pin 46 penetrates the holster body 3 so that the limiting device 4 is fixed in the holes 32. In this embodiment, two of the fixing pins 46 are sown as an example, but not limited thereto.

In embodiments of the current invention, the pluggable holster assembly features in the design of the gun holster. For example, the gun head and the trigger part are accommodated in the accommodating space to prevent the trigger from accidental operation that causes safety problems, thereby improving security.

Furthermore, through the design and combining of the accommodating groove and the buffer block, one-handed operation can be performed, and the drawing and reholstering of the gun body for the holster body becomes more efficiently. Specifically, the accommodating groove and the buffer block can be quickly limited and released quickly during operation that improves the drawing and reholstering speed of pistols (or firearms).

Additionally, through the design of the gap and the buffer block, the user can reholster the gun body into the holster body through the path in smoothly.

While this invention has been described with respect to at least one embodiment, the invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A gun holster assembly comprising:

a gun body including a gun head, a main part, a trigger part and a gun handle, the gun head having a muzzle, one end of the main part being connected to the gun head, the gun handle being connected to the main part and away from one side of the gun head, the trigger part being connected to the main part and the gun handle, and an accommodating groove being created between the trigger part and the gun head;

a holster body including an accommodating space and a hole, the accommodating space being configured through both ends of the holster body along a first direction, the accommodating space accommodating the gun head and the trigger part, and the hole being located on one side of the accommodating space;

a limiting device disposed in the hole, the limiting device including a buffer block, the buffer block extending from the hole to the accommodating space along a second direction, wherein, when the buffer block is in a first position, the buffer block extends from a surface of the accommodating space at a first distance;

wherein, when the gun body is inserted into the holster body, the muzzle is inserted into the holster body from a first side of the accommodating space along a path, and one end of the gun head abuts the buffer block, so that the buffer block is located on a second position; and when the muzzle moves to a second side of the accommodating space, the holster body covers the gun head and the trigger part, and the buffer block is located in the accommodating groove and restricts the gun body from moving;

wherein the limiting device further comprises a box body, an adjuster and a spring, the box body having a groove to which a third end of the adjuster is connected while one end of the spring is connected to a fourth end of the adjuster, and the other end of the spring is connected to the buffer block, so that the buffer block can be located at the first position or the second position via the spring;

wherein the limiting device further includes an adjusting screw, the adjusting screw being arranged in a through hole of the groove, and one end of the adjusting screw abutting the fourth end of the adjuster;

wherein, when the adjusting screw performs a rotational displacement movement through the through hole, the adjusting screw performs a linear displacement movement along the second direction, so that the adjuster performs the linear displacement movement.

2. The gun holstfirster assembly of claim 1, wherein the first direction is a direction along which the holster body extends, and the first direction is perpendicular to the second direction.

3. The gun holster assembly of claim 1, wherein, when the buffer block is located at the second position, the buffer block extends from the surface of the accommodating space at a second distance, and the second distance is less than the first distance.

4. The gun holster assembly of claim 1, wherein the limiting device further comprises at least one fixing plug, the at least one fixing plug is arranged on one side of the box body and penetrates the holster body, so that the limiting device is fixed in the hole.

5. The gun holster assembly of claim 1, wherein one side of the holster body corresponding to the hole is recessed along the first direction to form a gap.

6. The gun holster assembly of claim 5, wherein the path is a polyline path passing through the gap, and one or more turning points of the path are located on the buffer block.

7. The gun holster assembly of claim 1, wherein the end of the gun head abuts a surface of the buffer block, and the surface of the buffer block is an arc surface, a plane or a surface composed of a plurality of planes connected in series.

* * * * *